US006183225B1

(12) United States Patent
Thompson

(10) Patent No.: US 6,183,225 B1
(45) Date of Patent: Feb. 6, 2001

(54) ANGLED FLOW PORTS FOR RECIPROCATING PISTON PUMP

(75) Inventor: David J. Thompson, Oak Grove, MN (US)

(73) Assignee: Graco Minnesota Inc., Minneapolis, MN (US)

( * ) Notice: Under 35 U.S.C. 154(b), the term of this patent shall be extended for 0 days.

(21) Appl. No.: 09/219,298

(22) Filed: Dec. 21, 1998

Related U.S. Application Data

(60) Provisional application No. 60/070,368, filed on Jan. 2, 1998.

(51) Int. Cl.[7] ..... F04B 39/10; F04B 53/12

(52) U.S. Cl. ..... 417/554; 417/56; 166/105

(58) Field of Search ..... 417/554, 259, 417/455; 166/68.5, 105, 371

(56) References Cited

U.S. PATENT DOCUMENTS

| | | | | |
|---|---|---|---|---|
| 3,050,002 | | 8/1962 | Harris | 103/9 |
| 3,139,039 | | 6/1964 | Adams | 103/179 |
| 3,479,958 | | 11/1969 | Anderson et al. | 103/46 |
| 3,910,730 | * | 10/1975 | Gage | 417/554 |
| 3,966,360 | | 6/1976 | Greene | 417/53 |
| 4,229,149 | | 10/1980 | Turner | 417/554 |
| 4,395,204 | * | 7/1983 | Turner | 417/554 |
| 4,425,083 | | 1/1984 | Peterson et al. | 417/56 |
| 4,662,831 | | 5/1987 | Bennett | 417/430 |
| 4,664,186 | * | 5/1987 | Roeder | 166/68.5 |
| 4,685,517 | * | 8/1987 | Baggett | 166/105 |
| 4,875,833 | * | 10/1989 | Canaud et al. | 417/259 |
| 4,880,062 | * | 11/1989 | Blaud et al. | 166/371 |
| 5,382,142 | * | 1/1995 | Spears | 417/455 |

* cited by examiner

*Primary Examiner*—Teresa Walberg
*Assistant Examiner*—Leonid Fastovsky
(74) *Attorney, Agent, or Firm*—Douglas B Farrow

(57) ABSTRACT

A reciprocating piston pump is provided with angled flow ports to provide enhanced flow and reduced wear characteristics.

4 Claims, 3 Drawing Sheets

ANGLED FLOW PORTS FOR RECIPROCATING PISTON PUMP

RELATED APPLICATIONS

This application is a continuation-in-part of U.S. application Ser. No. 60/070,368, filed Jan. 2, 1998.

BACKGROUND OF THE INVENTION

Reciprocating piston pumps have been well known for many years for paint and other viscous materials. While current designs are generally satisfactory for their intended use, users are always desirous of increased packing life so as to prevent interruption of jobs and productivity.

SUMMARY OF THE INVENTION

It is therefore an object of this invention to provide a piston port design that reduces turbulence, Eddy currents, and loading in the piston are of the pump.

It is further an object of this invention to provide increased overall pump efficiency and performance and to eliminate the need for a piston ball stop as the invention creates its own from the rod material.

It is further an object of this invention to provide a sight window for ball wear inspection and thus eliminate the need to remove the piston head and damage the packing stack.

Depending on the pump sizing, the countersink hole will be in an optimum flow state which thereby reduces eddy currents and fluid traps by being machined to an angle within a range of 20–80 degrees. This angle also reduces potential wear patterns in the cylinder wall which can serve to reduce pump life.

The countersinks allow for a sight window that not only reduces restriction and blockage but allows visual inspection to review ball wear without removing the piston head. This countersink further provides radial and angular flows which serve to reduce side load to a minimum during the down stroke.

A flat from the flat bottom drilling provides a precise ball stop limiting ball travel tolerance to a desired distance. The angle must also be related to a dimension "A" as shown in the accompanying drawings and which is determined by the relationship between dimensions X, Y, Z and the 20–80 degree angle. With the two holes meeting at an angle, the pin for a ball stop is able to be removed and replaced with material from the rod thus reducing parts and assemblies in addition it provides precise ball travel dimension when combined with a one piece fixed head for the piston.

The ball head force pressure is in a direct line of the ball to enhance speed and direct line for seating. A key feature in making this design work is the internal ball guides machined into the piston to allow full ball guide alignment and full side exposure without allowing the ball to block the exit ports or escape through the ports.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
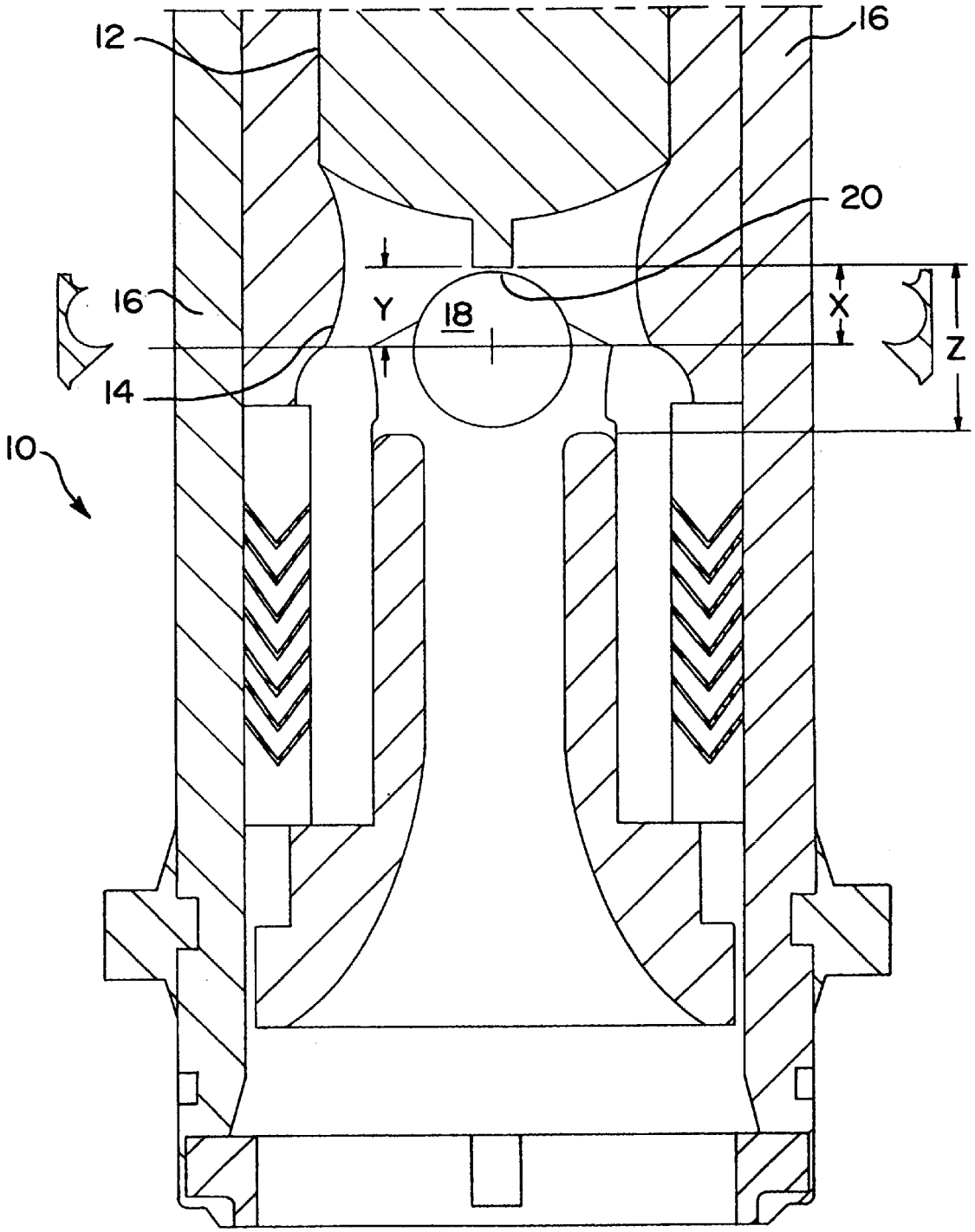
FIG. 1 is a cross-sectional view detailing the instant invention.
Figure 2:
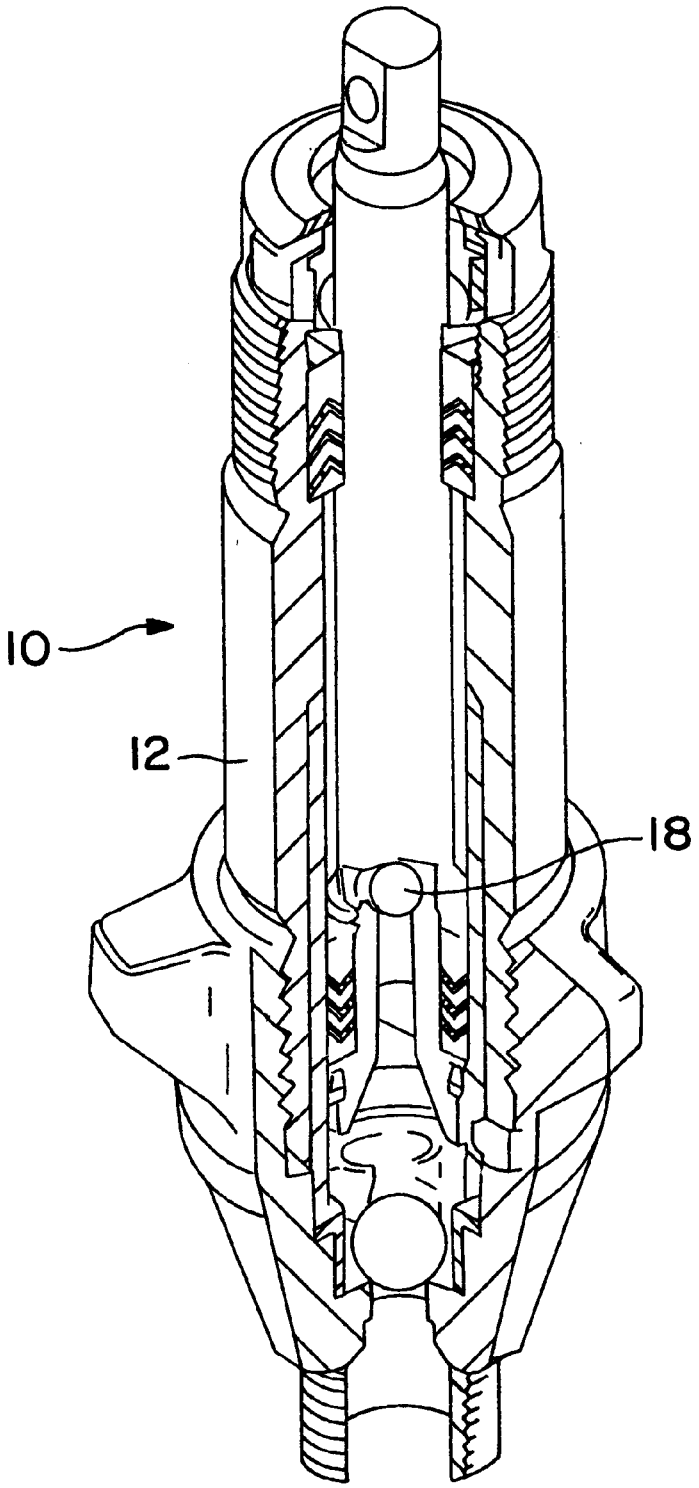
FIG. 2 is a cross-sectional view of the pump incorporating the instant invention.
Figure 3:
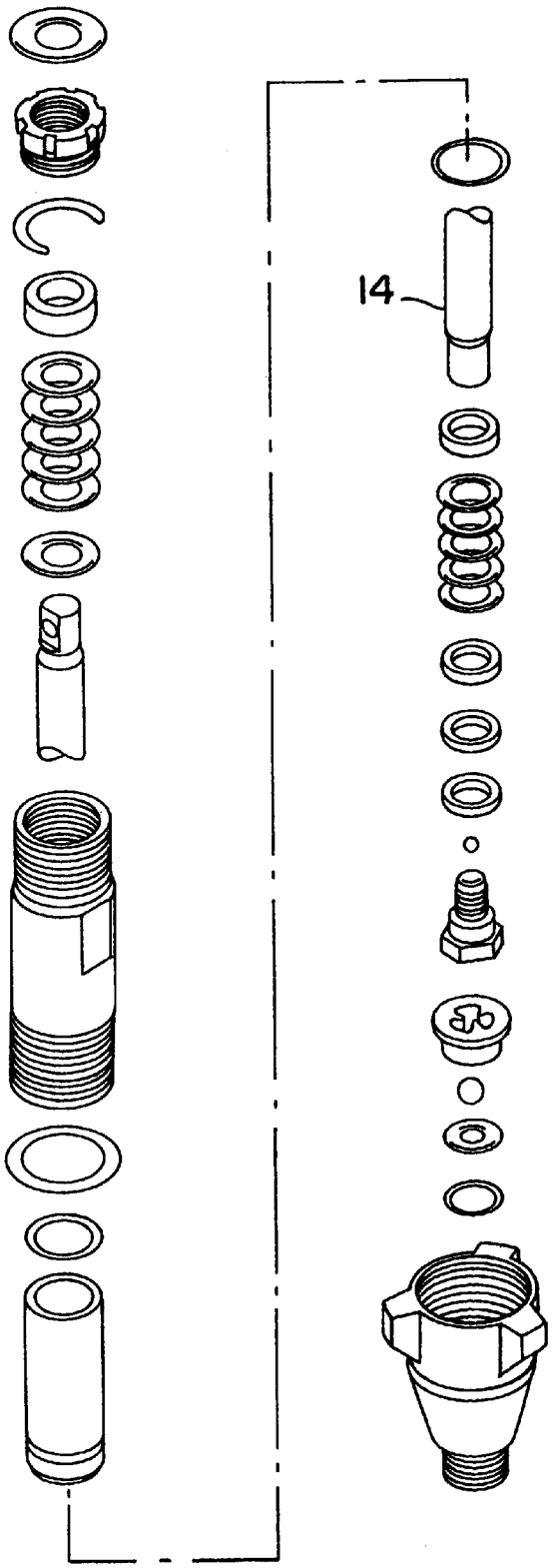
FIG. 3 is an exploded view of the pump incorporating the instant invention.

In a reciprocating piston pump generally designated 10, a rod 12 is provided with a countersunk flow port 14. Depending on the pump sizing, the countersink hole 14 will be in an optimum flow state which thereby reduces eddy currents and fluid traps by being machined to an angle within a range of 20–80 degrees (from the horizontal—total included angles will be from about 40 to 160 degrees). The preferred embodiment utilizes an included angle of about 40 degrees. This angle also reduces potential wear patterns in the cylinder wall 16 which can serve to reduce pump life.

The countersinks allow for a sight window that not only reduces restriction and blockage but allows visual inspection to review ball 18 wear without removing the piston head. This countersink further provides radial and angular flows which serve to reduce side load to a minimum during the down stroke.

A flat from the flat bottom drilling provides a precise ball stop 20 limiting ball travel tolerance to a desired distance. The angle must also be related to a dimension "A" as shown in the accompanying drawings and which is determined by the relationship between dimensions X, Y, Z and the 20–80 degree angle. With the two holes meeting at an angle, the pin for a ball stop is able to be removed and replaced with material from the rod thus reducing parts and assemblies in addition it provides precise ball travel dimension when combined with a one piece fixed head for the piston.

The ball head force pressure is in a direct line of the ball to enhance speed and direct line for seating. A key feature in making this design work is the internal ball guides machined into the piston to allow full ball guide alignment and full side exposure without allowing the ball to block the exit ports or escape through the ports.

It is contemplated that various changes and modifications may be made to the port design without departing from the spirit and scope of the invention as defined by the following claims.

What is claimed is:

1. In a reciprocating piston pump having a cylindrical rod with flow ports located therein, the improvement comprising said flow ports being generally tapered to increase in diameter in a radially outward direction.

2. The reciprocating piston pump of claim 1 wherein said ports have an included angle of between about 40 and 160 degrees.

3. The reciprocating piston pump of claim 2 wherein said ports have an included angle of about 40 degrees.

4. The reciprocating piston pump of claim 1 further comprising a ball stop formed of material integral with said rod.

* * * * *